US007344340B2

(12) United States Patent
Carlson et al.

(10) Patent No.: US 7,344,340 B2
(45) Date of Patent: Mar. 18, 2008

(54) METHOD AND ASSEMBLY FOR MAINTAINING STRUCTURAL STABILITY AND CONFIGURATION OF GOLF COURSE SAND BUNKER BORDERS

(75) Inventors: Eric J. Carlson, Andover, NJ (US); Timothy E. Kenney, Sussex, NJ (US)

(73) Assignee: Ames Rubber Corporation, Hamburg, NJ (US)

( * ) Notice: Subject to any disclaimer, the term of this patent is extended or adjusted under 35 U.S.C. 154(b) by 0 days.

(21) Appl. No.: 11/067,407

(22) Filed: Feb. 28, 2005

(65) Prior Publication Data

US 2006/0193703 A1 Aug. 31, 2006

(51) Int. Cl.
*E02D 17/20* (2006.01)

(52) U.S. Cl. ..... 405/302.6

(58) Field of Classification Search ..... 405/302.4, 405/302.6, 302.7, 262, 284, 286, 287, 15–17; 52/604, 606, 608; 473/173
See application file for complete search history.

(56) References Cited

U.S. PATENT DOCUMENTS 4,960,345 A 10/1990 Hurley et al.
5,108,231 A 4/1992 Rausch
5,154,542 A 10/1992 Klenert
6,663,323 B1 * 12/2003 Boys ..... 405/284
2004/0156679 A1 8/2004 Jenkins et al.

FOREIGN PATENT DOCUMENTS

JP 6-10366 * 1/1994
JP 8-41959 * 2/1996

* cited by examiner

*Primary Examiner*—Sunil Singh
(74) *Attorney, Agent, or Firm*—Lowenstein Sandler PC

(57) ABSTRACT

A method is provided for maintaining the structured stability and configuration of golf course sand bunker borders which method comprises excavating the soil area adjacent the bunker edge, rigidly positioning adjacent open-top, uniquely designed compartments in the excavated area along the edge of the bunker, filling the compartment with soil to the top of each compartment and leveling the soil on top of the compartments. Each compartment comprises side panels, front and back panels and a bottom closure panel. The compartment is rigidly positioned by means of spikes driven through the back and front panel into the soil at the edge of the bunker and a spike through the bottom closure into the soil beneath the sand in the bunker.

6 Claims, 11 Drawing Sheets

METHOD AND ASSEMBLY FOR MAINTAINING STRUCTURAL STABILITY AND CONFIGURATION OF GOLF COURSE SAND BUNKER BORDERS

FIELD OF THE INVENTION

The present invention relates generally to golf course sand bunkers and particularly related to a method and assembly for maintaining the structural stability and configuration of golf course sand bunker borders.

BACKGROUND OF THE INVENTION

Maintenance and beautification of a golf course not only requires knowledge of the golf course terrain and grassy fairways but also the scientific understanding of the nature and type of grass used on the fairways and the roughs adjacent the traps. Sand bunkers, or sand traps as they are often called, are integral parts of practically every golf course and require special attention in their design, location and configuration aimed at increasing challenge to golfers. Green keepers and maintenance crews frequently spend considerable time in maintaining the sand bunkers and attempting to preserve the configuration and aesthetics of the bunkers, often at increased costs. It is a matter of common experience that heavy rain washes down the sides of the bunker, and golfers, animals and golf maintenance equipment entering and leaving a bunker aggravate damage to the bunker borders, thus requiring frequent repairs. Bunker border refers to that area where the sand within the bunker meets the soil and the sod surrounding the bunker.

Maintenance of sand bunkers has received its share of attention in the prior art as is evidenced by several patents and publications which relate to solutions to this problem. One such publication is Publication No. U.S. 2004/0156679 A1 issued Aug. 12, 2004, in the name of Christopher Jenkins, titled "Method And Material For Preventing Erosion And Maintaining Playability Of Golf Course Sand Bunkers". This publication discloses the use of a geotextile liner which comprises a first non-woven water-permeable liner configured to maintain sand in place within the bunker, and a second water-permeable backing layer secured to the first layer for preventing downward migration of sand through the liner as well as preventing upward migration of weeds, rocks, and other contaminants.

U.S. Pat. No. 4,960,345 issued Oct. 2, 1990 to Hurley et al. discloses a system for constructing golf course traps. A liner is used to cover the sides and bottom of the bunker to catch rainwater and convey it out of the bunker in order to prevent erosion of the bunker borders.

U.S. Pat. No. 5,108,231 issued Apr. 28, 1992 to Peter Rausch for "Embankment Block" discloses an embankment block having a framelike design for construction of embankment structure on which plants can be planted.

U.S. Pat. No. 5,154,542 issued Oct. 13, 1992 to Oscar H. Klenert for "Retaining-Earth Module, System And Method" discloses the use of stacked concrete row of blocks to form a retaining wall filled with sand or earth to control erosion. The concrete blocks are fastened to each other by pins or bolts located at the sides, and aligned side notches at the top to permit to insertion of individual blocks of a higher row of blocks.

So far as is known no system or assembly has been found entirely suitable for installation along sand bunkers, specifically the perimeter edges where the sand meets the surrounding soil and turfgrass, to maintain the stability and configuration of the bunker border without resorting to the time consuming, laborious and expensive maintenance which are prevalent in maintaining golf courses bunkers.

It is therefore an object of the present invention to provide a system which is designed uniquely for installation alongside borders of sand bunkers to prevent erosion and damage due to traffic and to maintain the stability and configuration of the bunker borders.

It is also an object of the present invention to provide a method of maintaining the structural stability of bunker borders and retaining their configurations.

The foregoing and other objects and features of this invention will be understood and appreciated from the ensuing detailed description of the invention and the several drawings which form parts of this application.

SUMMARY OF THE INVENTION

The present invention provides a method for maintaining structural stability and configuration of golf course sand bunker borders, which comprises excavating an area of the soil adjacent the perimeter of the sand bunker and placing a plurality of adjacent (side-by-side) compartments in said excavated area. Each compartment has an open top and is defined by two generally parallel side panels, generally parallel front and rear panels and a bottom closure panel. Each compartment is rigidly fixed against the edges of the bunker such as, for example, by at least one, preferably two spaced apart spikes passing through the rear and front panels into the soil area, and one or more spikes driven through the bottom closure panel into the soil beneath the sand for added rigidity of the compartment. Each compartment is then filled with soil to the top of the compartment and the soil in each compartment is leveled and tamped to cover the compartment.

In one embodiment of the invention the compartments are aligned side-by-side to the configuration of the bunker edge and the facing side panels of adjacent compartments are connected to each other by means of a flexible hinge which may be a generally V-shaped in configuration. In another embodiment of the invention, the side panels may be tapered and the side panel of one compartment having a round notch or socket with the facing side panel of the adjacent compartment having a ball such that the ball is adapted to frictionally engage in the socket to provide the interconnection between successive adjacent compartments.

BRIEF DESCRIPTION OF THE DRAWINGS

Referring to the drawings, wherein like reference numerals are used to designate like parts.

DETAILED DESCRIPTION OF THE INVENTION

Figure 1:
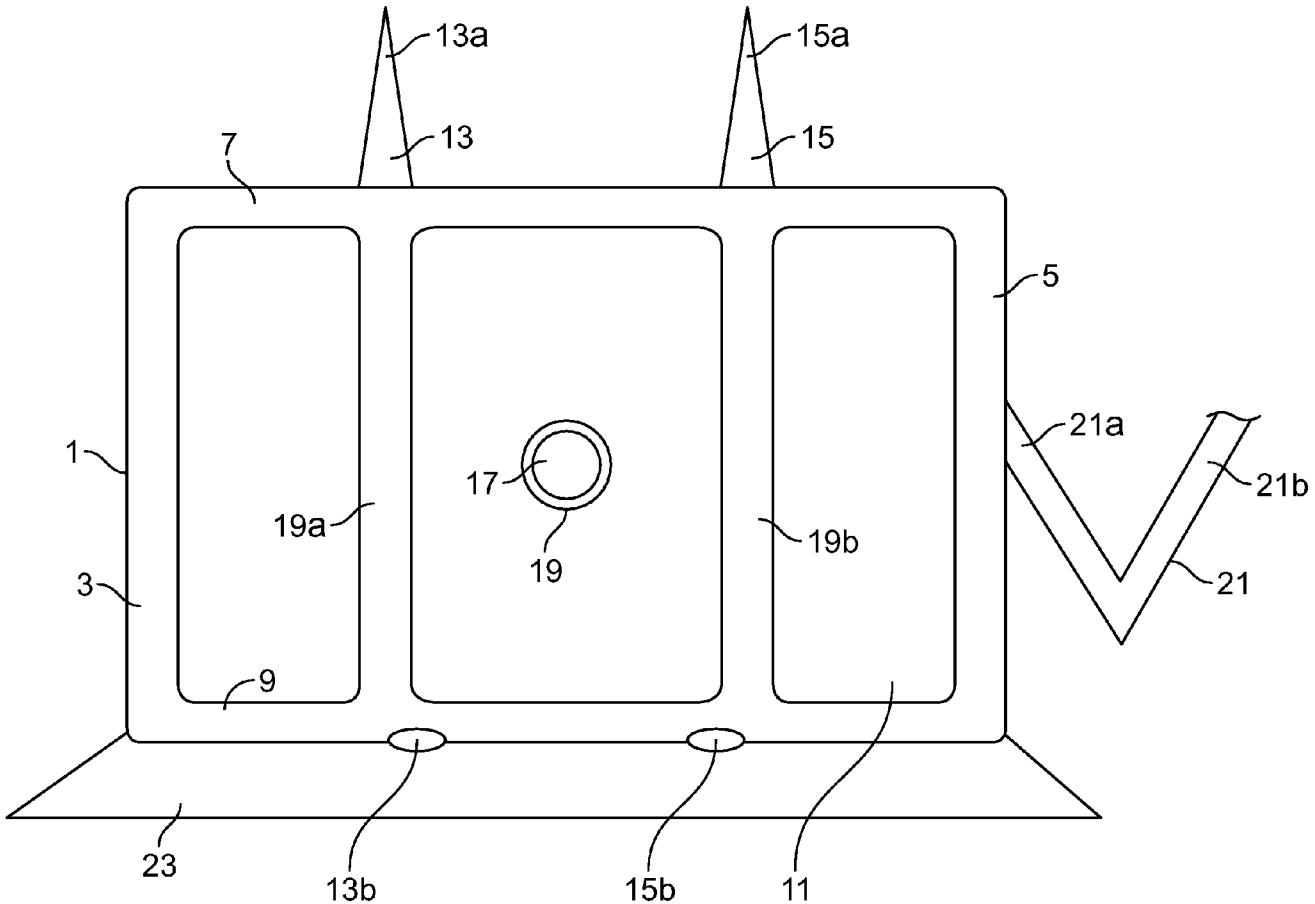
FIG. 1 is a topview of a single compartment used in the present invention.
Figure 2:
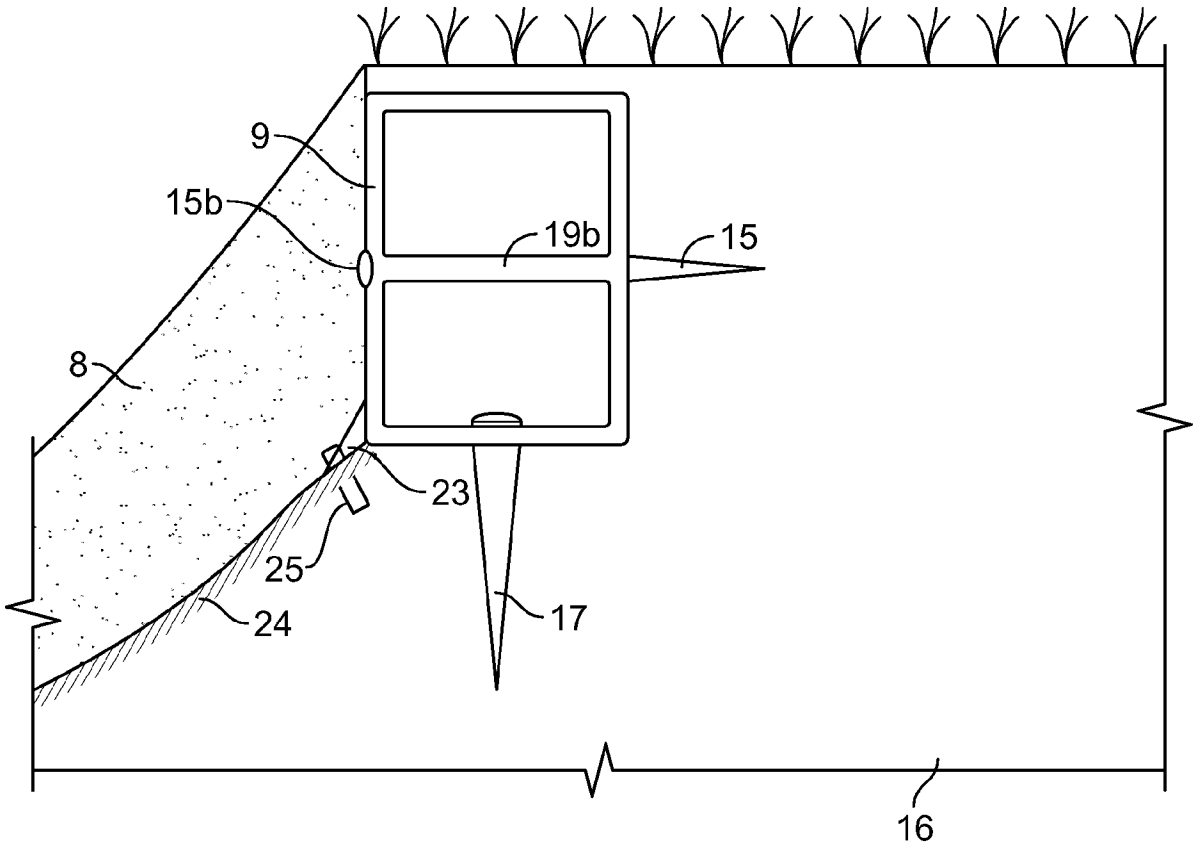
FIG. 2 is a side view of the compartment shown in FIG. 1.

The compartment illustrated in FIGS. 1 and 2 are generally designated as 1 and comprises two generally parallel side panels 3 and 5, a front panel 7, a generally parallel rear panel 9 and a bottom closure panel 11. Compartment 1 is open at its top and is provided with two spaced apart generally parallel spikes 13,15 each of which protrude through the front panel 7 and the rear panel 9 a pre-desired distance into the soil area 16 as shown in FIG. 2 and will hereinafter be described in more detail. The font ends 13*a*,15*a* of each spike 13,15 is sharpened in a projectile-like manner for ease of insertion and securement into soil around sand bunker area 8 and each spike terminates at its rear end with an enlarged spike head such as 13*b*,15*b* each of which abuts against the rear panel 9 when each spike is inserted through the soil to its fullest length. Within the compartment 1 each spike is disposed within its respective sleeve 19*a*,19*b* and is adapted to be rotably advanced into and through the soil area 16 by hammering on the spike head or twisting by hand until each compartment is secured against bunker side. The sleeves 19*a* and 19*b* are secured against the inside walls of the front panel 7 and rear panel 9 by a brace, adhesive, or they may be preformed during molding of the compartment, or by ay other suitable securement means. It must be mentioned that the provision of such sleeves is not strictly necessary but is desirable since the compartment will be filled with soil and the sleeves insure free rotation and forward advance of each spike into the soil. The bottom closure panel 11 has a centrally located aperture 19 through which a spike 17 similar to the spikes 13 and 15 is inserted for securement to the soil beneath the sand as shown in FIG. 2. The overall structural embodiment of the open top compartment described in detail above is preferably constructed of a high impact plastic or high impact rubber capable of withstanding the environmental conditions, as well as traffic traversing the fairway of the golf course.

Figure 3:
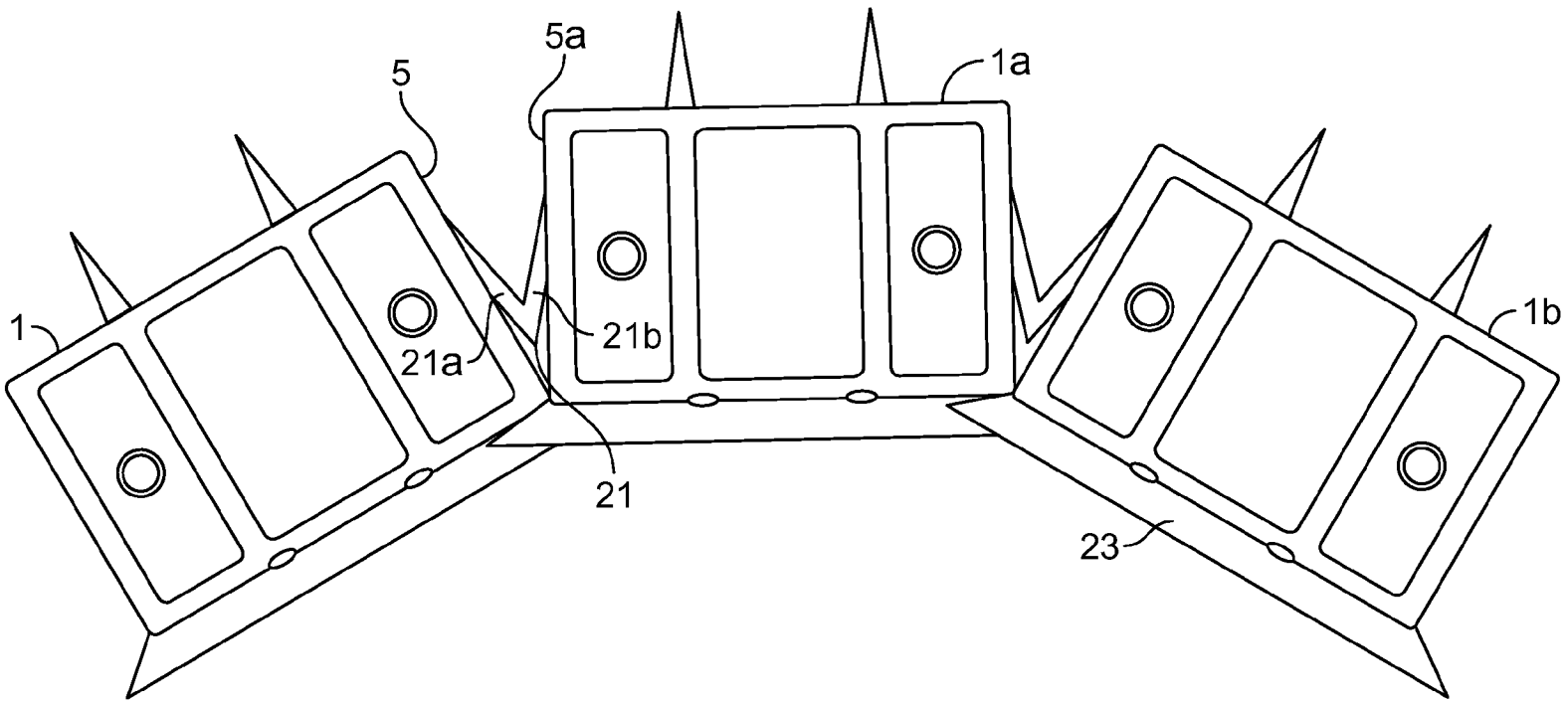
FIG. 3 is a top view showing three adjacent compartments connected to each other according to one embodiment of the present invention.

Referring to FIG. 3, there is shown an assembly of three compartments, each as shown in FIG. 1, which are interconnected by means of a flexible generally V-shaped hinge 21 defined by the arms 21*a*,21*b* with the arm 21*a* being secured to outside of the panel 5 and the side edge 21*b* secured to the outside of panel 5*a* of the adjacent compartment 1*a*. The flexible hinge 21 may be stretched to increase the separation between adjacent compartments, or it may be compressed to decrease the distance between adjacent compartment as desired. As is also shown in FIGS. 1-3, a flap 23 is attached along the bottom of the outer wall of the front panel 9 (three such flaps being shown in FIG. 3) which serve to anchor and overlap the bunker lining 24, when a bunker lining is desired or necessary. A sod staple 25 secures each flap to the soil as shown in FIG. 2.

Figure 4:
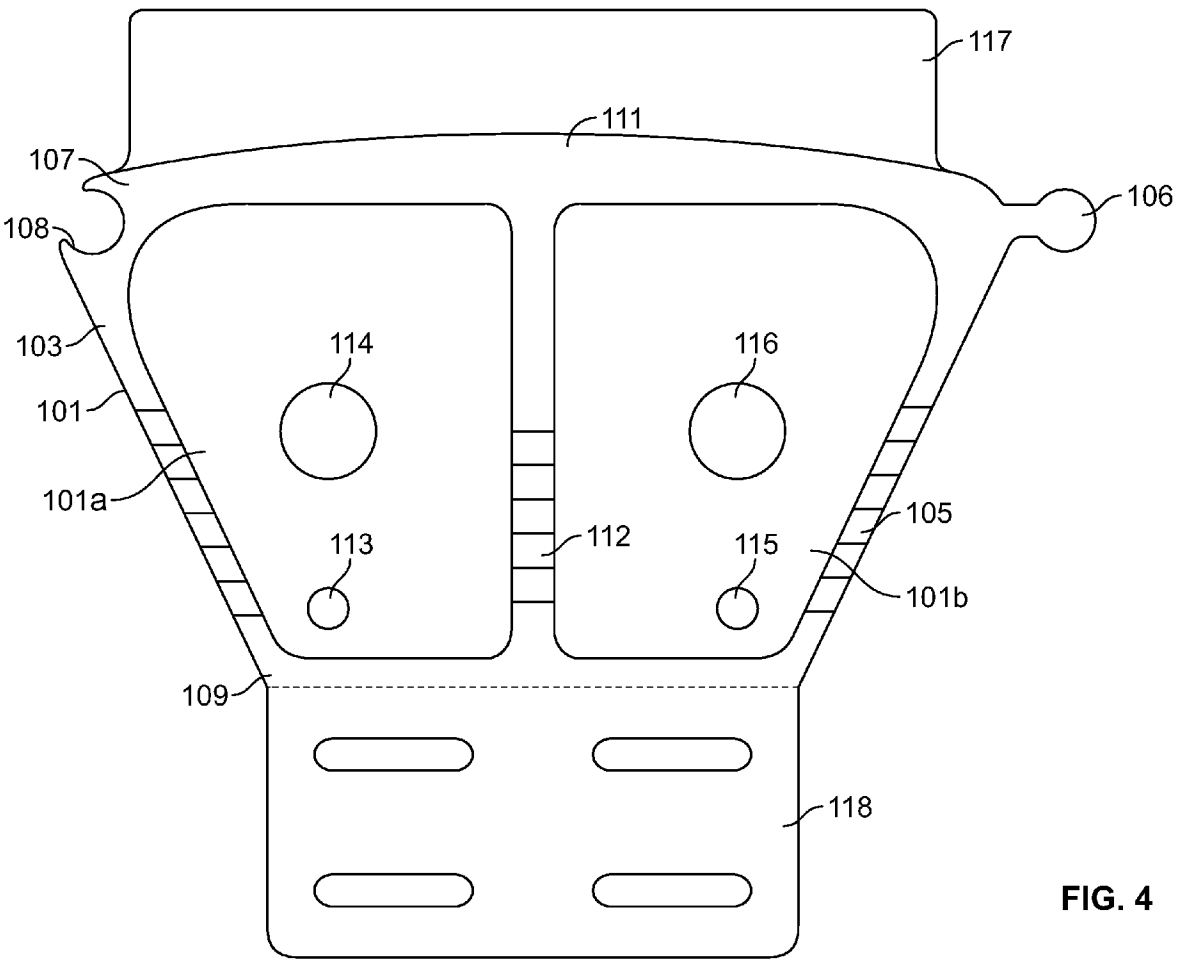
FIG. 4 is a top view of a single compartment according to a different embodiment of the present invention.
Figure 5:
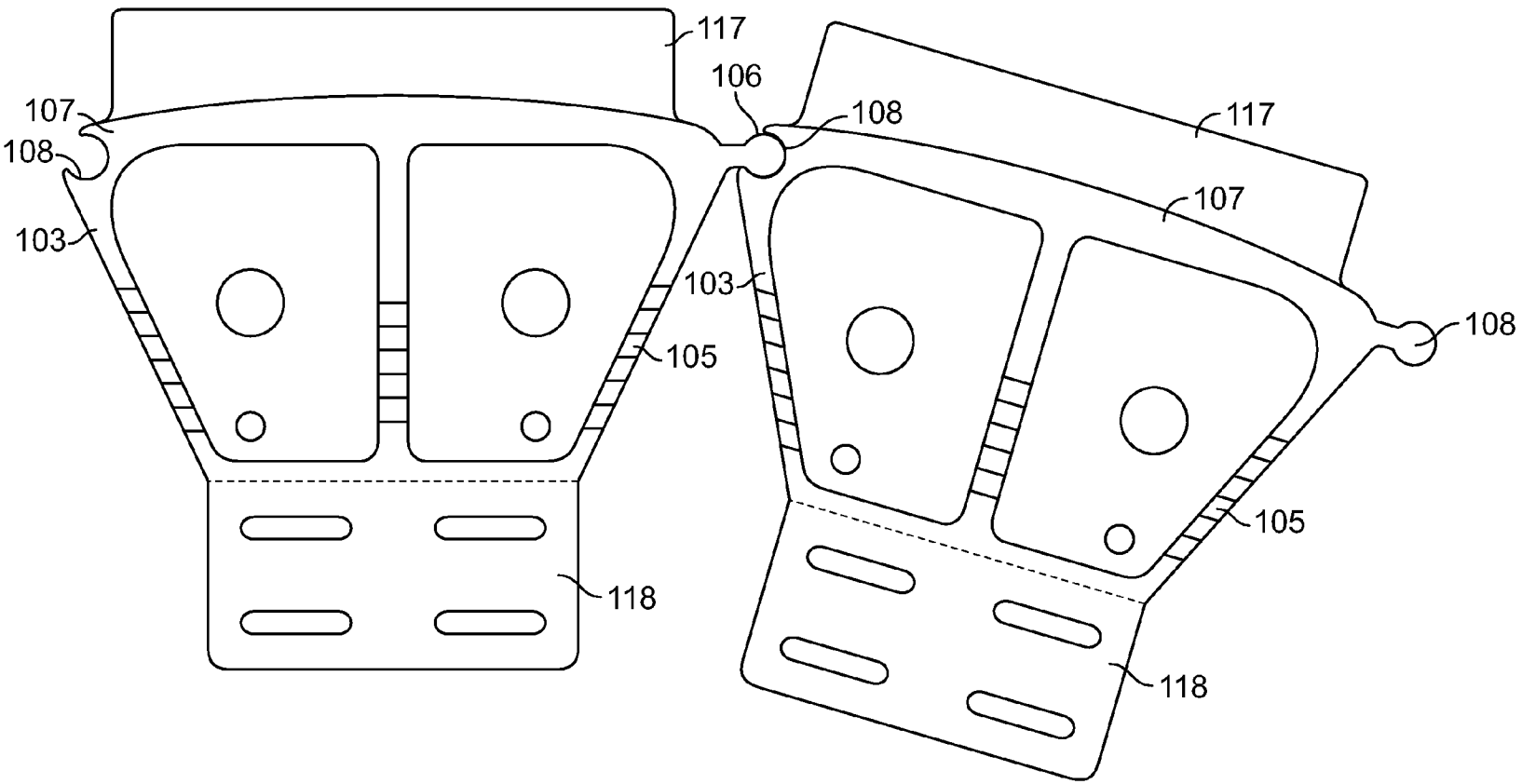
FIG. 5 is a top view of two compartments, each as shown in FIG. 4 but illustrating a different interconnection means for connecting adjacent compartments along the edges of a sand bunker.

In FIGS. 1-3, the compartments are shown to be connected by flexible hinge members which may conveniently be V-shaped in configuration. The interconnection means however is not intended to be limited to hinge members. In a different embodiment of the present invention, adjacent compartments are connected by means of a ball and socket joint uniquely designed to permit adjacent compartments to be positioned in place while allowing a desired distance or separation between them and the ability to follow the contour of the bunker border. Thus, referring to FIGS. 4 and 5, there is shown in FIG. 4, a compartment generally designated as 101 comprising tapered side panels 103,105, a front panel 107, a generally parallel rear panel 109, and a bottom closure panel 111. The compartment 101 is open at the top and is provided at its bottom closure panel 111 with two spike holes 113,115 for insertion therethrough of spikes as in the compartment shown in FIG. 1. A divider panel 112 has its lower end affixed to the bottom closure panel 111 and extends up in the compartment terminating at or near the open top for added structural integrity of the compartment. The divider panel 112 conveniently divides the compartment 101 into two sub-compartments 101*a*,101*b* with each spike hole located in the bottom closure of the sub-compartments. Drainage holes 114,116 are provided in the bottom closure at each of the sub-compartments. Similar to the open top compartment illustrated in FIGS. 1-3, the overall structural embodiment of the open top compartment described in detail above in conjunction with the embodiment illustrated in FIGS. 4 and 5 is preferably constructed of a high impact plastic or high impact rubber capable of withstanding the environmental conditions, as well as traffic traversing the fairway of the golf course.

A flap 117 is attached to the front panel 107 or may be formed as an extension thereof, and a flap 118 is attached to the top of the rear panel 109 or may be formed as an extension thereof. The provisions of these flaps improves the anchoring stability of the compartment.

As is further shown in FIG. 4, the compartment 101 (and each adjacent compartment in the assembly) has a ball and socket with each ball of one compartment adapted to be frictionally engaged into the socket of the next compartment. This arrangement allows for maintaining continuity between adjacent compartments while allowing the compartments to follow the contour of the bunker border.

The ball and sockets are usually formed when molding the compartments so that the ball of one compartment will be frictionally engaged in the socket formed in the adjacent compartment. FIGS. 4 and 5 show a ball 106 formed at the intersection of the front panel 107 and side panel 105 and a socket 108 formed at the intersection of the front panel 107 at side panel 103.

Figure 6:
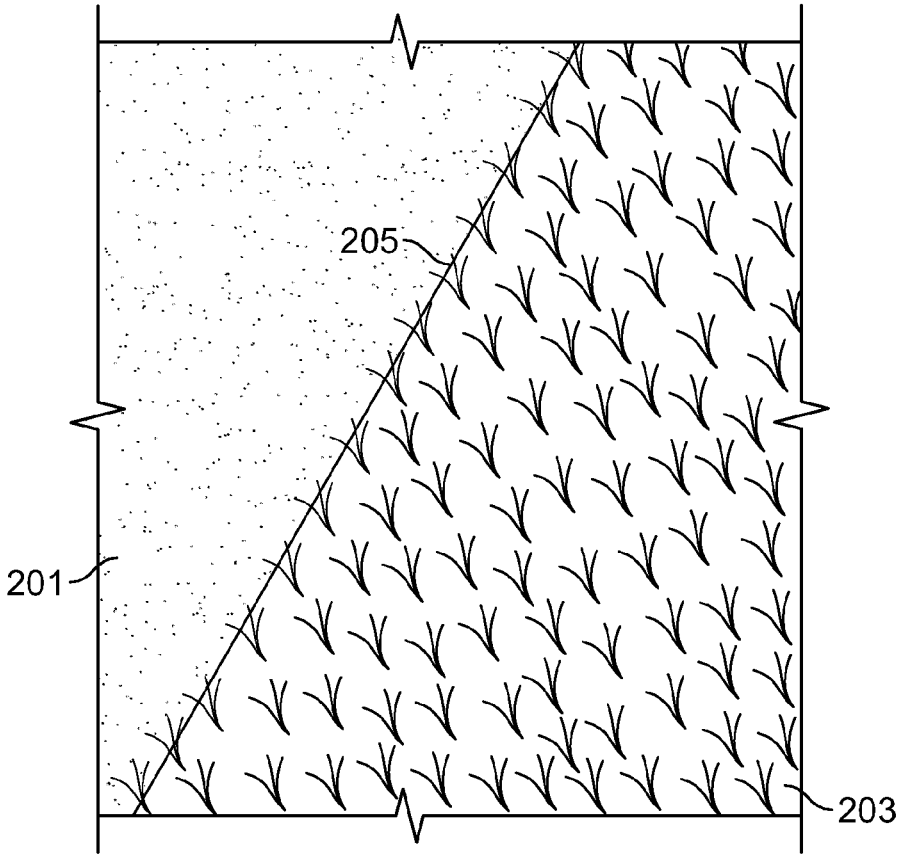
FIG. 6 is a top view of a bunker border showing the sand-grass interface.
Figure 7:
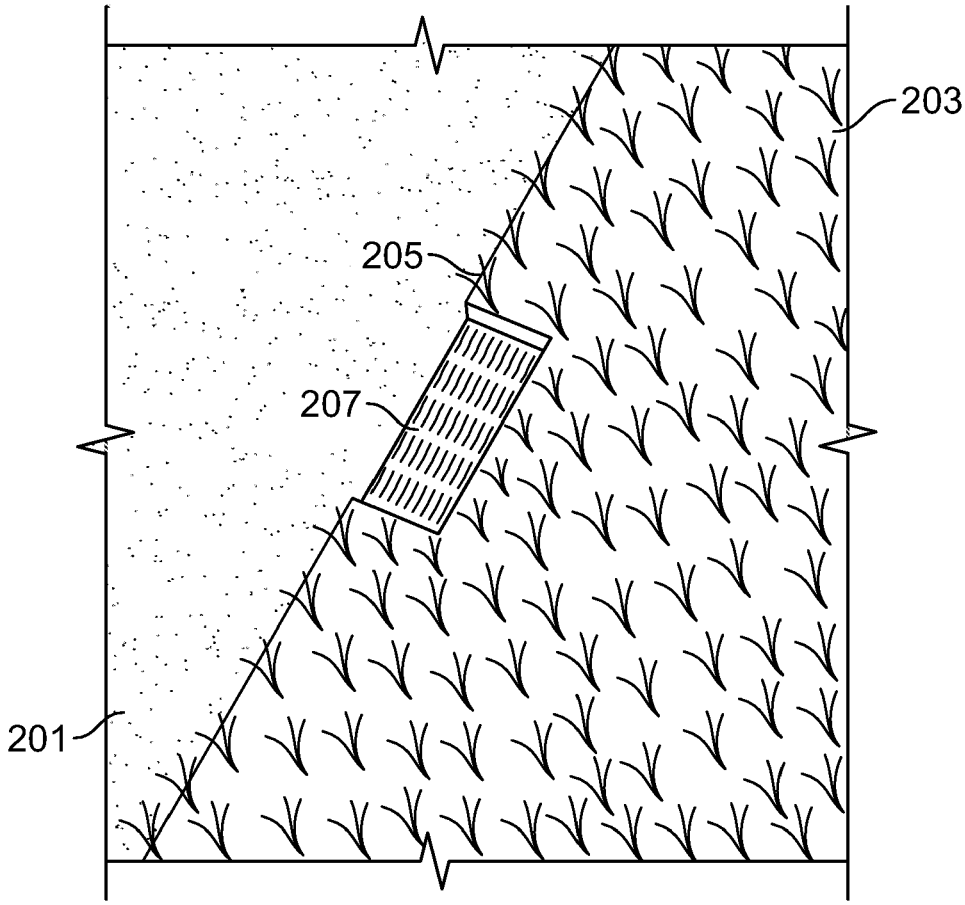
FIG. 7 is a top view of the bunker border shown in FIG. 6 but wherein an area of the sod is excavated to accommodate the positioning of an assembly of two compartments such as the compartment shown in FIG. 1.
Figure 8:
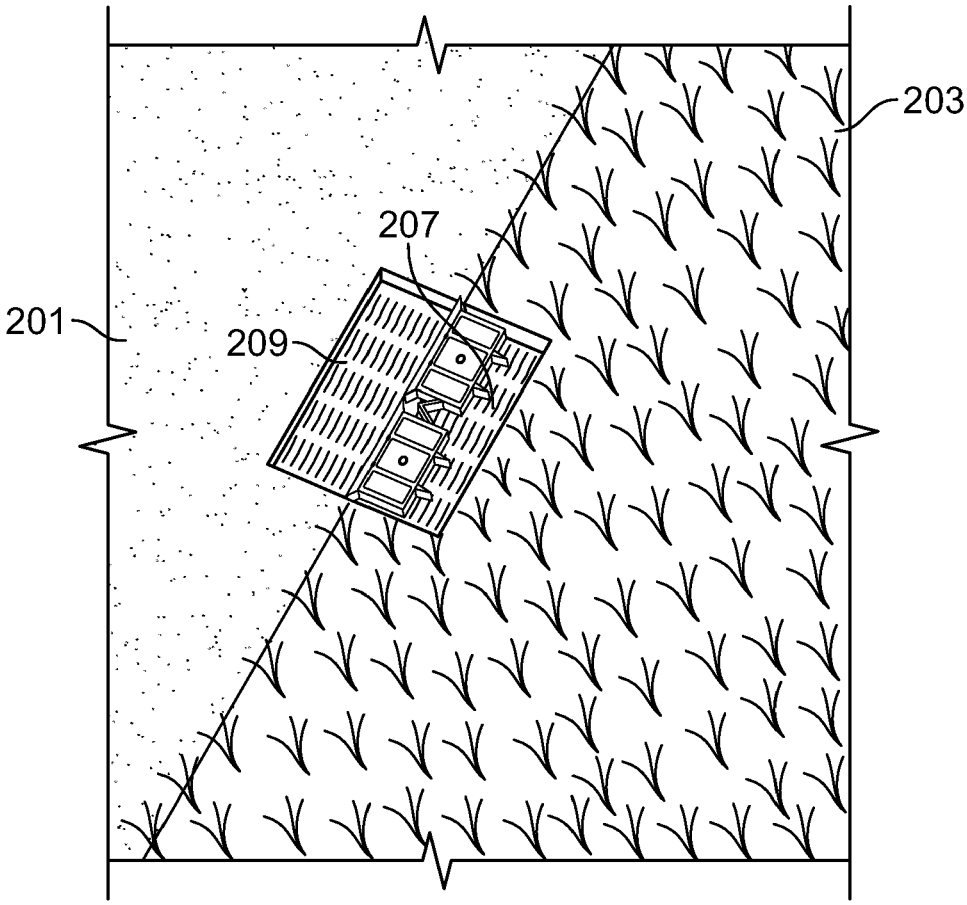
FIG. 8 is a view similar to FIG. 7 with two compartments positioned in the excavated area where the sod is removed.

The method of the present invention will now be described with reference to FIGS. 6-11. Thus, FIG. 6 illustrates an area portion of a golf course fairway focusing on a sand bunker 201, adjacent fairway area 203 and shows a normal bunker edge 205 which may be a newly constructed bunker. The first step of the method of this invention comprises excavating the sod around the bunker edge to form an excavated area 207 roughly the size and height of the compartments to be placed in that area, see FIG. 7. It can be appreciated that this procedure is carried out along the entire bunker edge for each sand bunker and the assembly of compartments are fitted into the excavated area. In FIG. 8, two compartments, each constructed as the compartment illustrated in FIG. 1, and interconnected as shown in FIGS.

Figure 9:
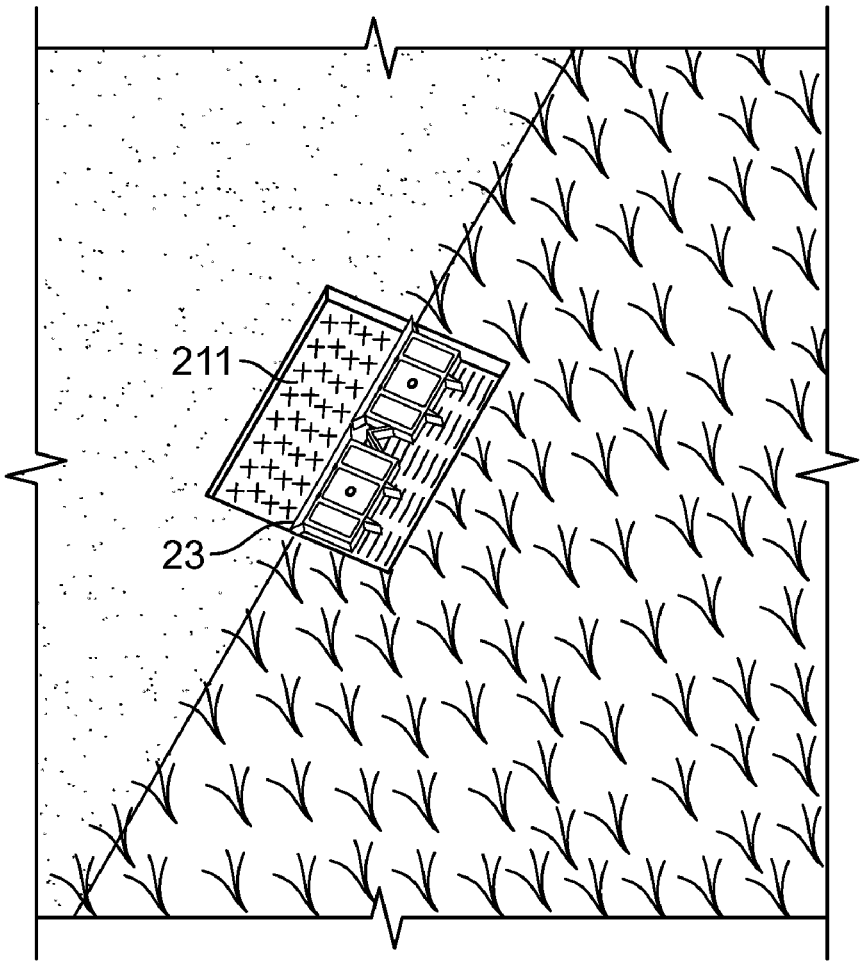
FIG. 9 is a view similar to FIG. 8 with the two compartments spiked into position against the bunker border, and showing a lining material stapled to side flaps extending from the sides of each compartment.
Figure 10:
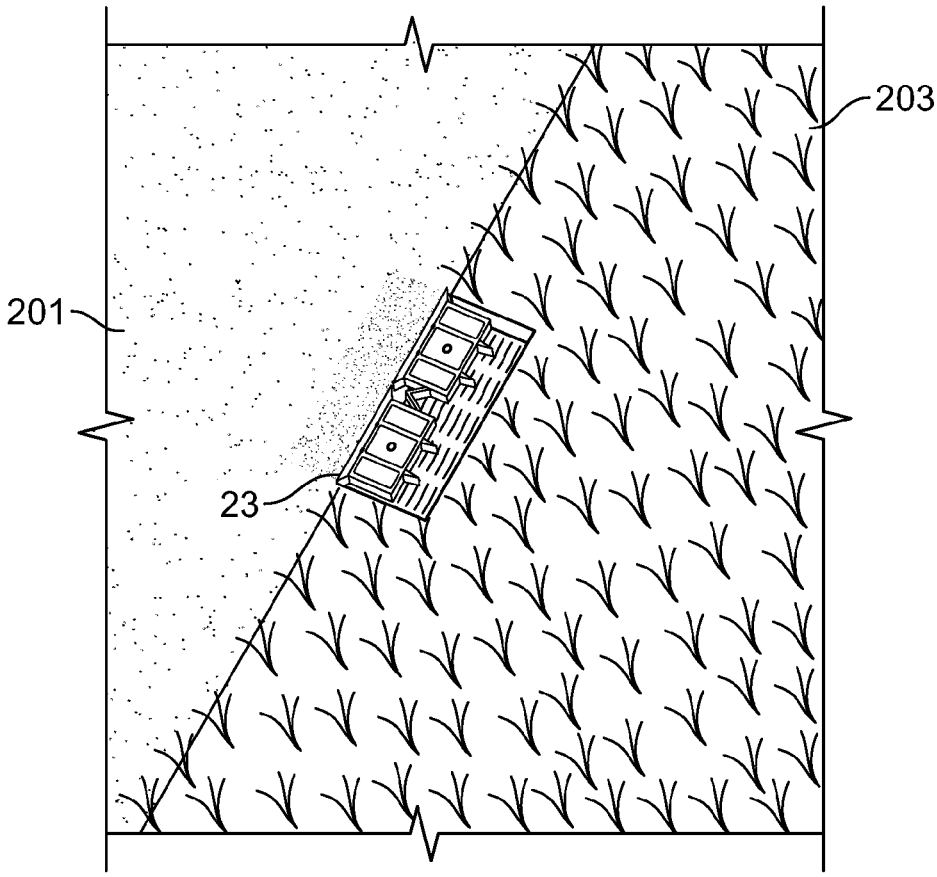
FIG. 10 is a view similar to FIG. 9 showing the compartments filled with soil or rootzone mix with the sand spread back on up to the face of the bunker border.
Figure 11:
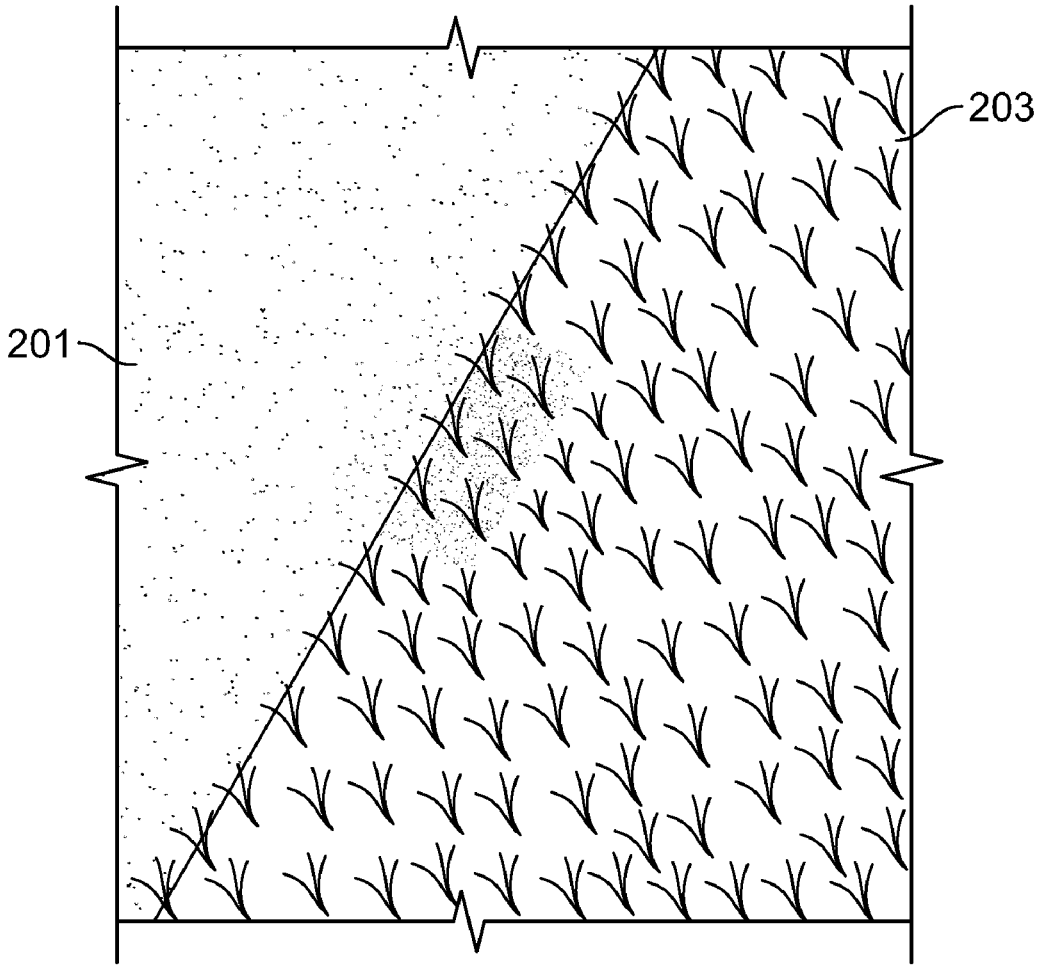
FIG. 11 is view of the finished bunker border with the soil covering the area in which the compartments are placed.

2 and 3, are placed in the excavated area 207. As is also shown in FIG. 8, the sand in the bunker is removed or pulled down until the soil area 209 becomes visible. The compartments are then placed side-by-side into the excavated cavity 207 where it will strengthen the bunker edge and separates the sand from the soil. This arrangement is along the entire sand bunker edge where the sand is prone to erosion. Referring to FIG. 9, each compartment is then spiked into place by inserting a pair of spikes, such as the spikes 13,15 shown in FIG. 1, through each rear only compartment into the soil in order to rigidly place the compartments in position in the excavated area. A similar spike, such as the spike 17 shown in FIG. 2, is driven through the bottom closure panel of each compartment to increase the structural rigidity of each compartment. Each pair of compartments may be connected together by means of the flexible hinge members but, alternatively, the compartments may be placed in the excavated area contiguously without interconnecting means, and rigidly affixed to the soil as hereinbefore mentioned. As is further shown in FIG. 9, a liner 211 is placed below the flaps 23 and is stapled thereto, and serves to separate the sand from the underlying soil in the bunker. The lining materials of the liner 211 may be synthetic fabrics such as geotextile or other suitable material. After the compartments have been rigidly placed in the excavated area and against the sand bunkers edge, the compartments are filled with soil to provide rooting area for the sod, and the soil is tamped inside the compartments to minimize settling. The sand is then pulled bank to the face of the bunker edge (see FIG. 10) and the sod is placed over the bunker edges, covering each compartment in the excavated cavity, up to the perimeter of the bunker. FIG. 11 shows the final view of the finished bunker.

The method hereinbefore described for maintaining the structural stability and configuration of sand bunker borders are equally applicable using compartments such as shown and described in FIGS. 4 and 5. When such compartments are used, each two compartments are placed in the excavated cavity, one next to the other, while insuring that the ball of one compartment is frictionally engaged into the socket of its adjacent compartment, and so on along the perimeter of the bunker. The choice of the type of units employed depends on the relative convenience of manufacture of the compartments. Both types, however, are amenable to be used in the method of this invention, and both types afford convenient method of insuring the structure and stability of the sand bunker borders and help maintain their desired edge configurations. These compartments or units may therefore be conveniently called "Bunker Borders".

While the invention has heretofore been described with certain degrees of particularity, both in the structures of each Bunker Border, the method described herein may be amenable to some changes and modifications which are suggested by, or obvious from the foregoing detailed description. Such changes and the modifications are nevertheless within the scope of the present invention.

The invention claimed is:

1. A method for maintaining the structural stability and configuration of a sand bunker border, said method comprising the steps of:

excavating an area of the soil adjacent a perimeter of said sand bunker;

placing a plurality of adjacent open top compartments in said excavated area, wherein each of said compartments comprises a first joining member and a second joining member, said first joining member being associated with a first side panel of said compartment, said second joining member being associated with a second side panel of said compartment, and said first and second joining members being adapted for pivotal connections to joining members of adjacent compartments;

affixing said plurality of compartments against said perimeter of said sand bunker; and filling open tops of said plurality of compartments with soil substantially to the top of each of said compartments.

2. The method of claim 1, further comprising the step of pivotally connecting said plurality of compartments.

3. The method of claim 2, further comprising the step of pivotally adjusting said pivotally connected plurality of compartments to conform to a desired shape of said perimeter of said sand bunker.

4. The method of claim 1, wherein the step of affixing said plurality of compartments against said perimeter further comprises the step of rigidly anchoring said plurality of compartments by driving at least one stake member through at least one of said compartments and into soil underlying or abutting said at least one compartment.

5. The method of claim 1, further comprising the step of positioning said plurality of compartments in said excavated area so that the height of each compartment is slightly below the height of said excavated area.

6. The method of claim 1, further comprising the step of leveling said soil on top of said plurality of compartments.

* * * * *